US006153119A

United States Patent [19]

Sung

[11] Patent Number: 6,153,119

[45] Date of Patent: Nov. 28, 2000

[54] METHOD AND PRODUCT FOR REDUCING TAR AND NICOTINE IN CIGARETTES

[76] Inventor: Michael Sung, 1604 Reston Ct., Raleigh, N.C. 27614

[21] Appl. No.: 08/854,208

[22] Filed: May 9, 1997

[51] Int. Cl.[7] ..... C01B 11/18; C01B 15/04; C01B 15/055; A24B 15/28

[52] U.S. Cl. ..... 252/186.25; 252/186.26; 252/186.27; 252/187.31; 131/334; 131/79

[58] Field of Search ..... 131/334, 79, 371, 131/274, 275; 252/186.25, 186.26, 186.27, 186.43, 187.31; 106/243

[56] References Cited

U.S. PATENT DOCUMENTS

| | | | |
|---|---|---|---|
| 2,158,565 | 5/1939 | Andrews | 131/352 |
| 3,180,458 | 4/1965 | McFarland et al. . | |
| 3,380,458 | 4/1968 | Touey et al. . | |
| 3,720,214 | 3/1973 | Norman et al. . | |
| 3,782,393 | 1/1974 | Michelson . | |
| 3,893,464 | 7/1975 | Norman et al. . | |
| 3,916,914 | 11/1975 | Brooks et al. | 131/175 |
| 3,943,940 | 3/1976 | Minami . | |
| 4,216,784 | 8/1980 | Norman et al. . | |
| 4,231,377 | 11/1980 | Cline et al. . | |
| 4,236,533 | 12/1980 | de Clara . | |
| 4,248,251 | 2/1981 | Bryant, Jr. et al. . | |
| 4,317,460 | 3/1982 | Dale et al. . | |
| 4,397,321 | 8/1983 | Stuetz . | |
| 4,489,739 | 12/1984 | Mattina, Jr. et al. . | |
| 4,561,454 | 12/1985 | Guess . | |
| 4,620,554 | 11/1986 | Horimoto | 131/270 |
| 5,121,759 | 6/1992 | Dixit et al. . | |
| 5,256,681 | 10/1993 | Raeymaekers et al. | 514/373 |
| 5,462,072 | 10/1995 | Browne et al. . | |
| 5,505,875 | 4/1996 | Beaujean et al. | 252/186.27 |
| 5,695,679 | 12/1997 | Christie et al. | 252/186.26 |
| 5,713,376 | 2/1998 | Berger | 131/270 |
| 5,746,231 | 5/1998 | Lesser et al. | 131/334 |

*Primary Examiner*—Joseph D. Anthony
*Attorney, Agent, or Firm*—Oliff & Berridge, PLC

[57] ABSTRACT

A process, and product which uses the process, for reducing tar and nicotine in cigarettes, whereby a novel emulsified complex of Sterotex/permanganate is incorporated into a cigarette. The complex displays a synergistic reaction having a dose response relationship permitting linear adjustment to reduce more than 85% of the tar and nicotine in the mainstream smoke of a cigarette. Chemical analysis of the smoke condensate demonstrates the oxidation of nicotine to nicotinic acid, a B6 vitamin.

11 Claims, 7 Drawing Sheets

NICOTINE

NICOTINIC ACID

N-METHYL-4-(2'-PYRIDINYL) BUTYROLACTAM

N-METHYL-4-(2'-PYRIDINYL) BUTYRIC ACID

THE OXIDATION OF NICOTINE TO NICOTINIC ACID

Nicotine
Nicotinic Acid

500:1
100:1
10:1
1:1

Nicotine
Nicotinic Acid

500:1
100:1
10:1

1:1

METHOD AND PRODUCT FOR REDUCING TAR AND NICOTINE IN CIGARETTES

BACKGROUND OF THE INVENTION

1. Field of Invention

This invention relates to a chemical process, and product which uses the process, for reducing tar and nicotine in cigarettes.

2. Description of the Related Art

The existence of tar and nicotine in cigarette smoke has presented a very serious problem in cigarettes for many years. The extent of the health hazards associated with the tar and nicotine have been the focus of many studies and much publicity in recent years. The tar and nicotine in the cigarette smoke is the result of partial combustion. The tar and nicotine exists in both the mainstream smoke, which the smoker draws from the cigarette, and the sidestream smoke, which is commonly known as "second-hand" smoke. Thus, there has been a long-felt need for effective reduction and control of tar and nicotine levels in smoking articles, such as cigarettes, pipes, and cigars.

Conventionally, attempts to reduce or control tar and nicotine levels in cigarette smoke have focused on filters which physically remove particulate matter, such as tar and nicotine, from the mainstream smoke condensate, thereby reducing the total particulate matter ("TPM") in the smoke condensate. Thus, the range of cigarettes, from the "full flavor" cigarette to the "light" cigarette to the "ultralight" cigarette, are graded according to the effectiveness of their filters, which can eliminate approximately 50% of the potential tar and nicotine in a normal unfiltered cigarette. Further refinement of filter technology has led to the invention of laser perforated high porosity air dilution filters to further reduce the tar and nicotine in the mainstream smoke. Even these filters, however, fail to reduce the tar and nicotine levels sufficiently and fail to provide adequate control of the tar and nicotine levels.

To-date, the prevailing features of tar and nicotine control in the cigarette industry are all through "physical methods." Physical methods are limited in their range of control and cannot totally eliminate all tar and nicotine from the cigarette. Additionally, the physical methods change flavor and character of the smoke, thereby reducing the enjoyment of smoking and leaving the smoker unfulfilled. For example, some of the light and ultra-light cigarettes have very fine filters which require a great deal of effort to "draw" smoke from the cigarette. While the filter reduces tar and nicotine in the mainstream smoke, it does not reduce the tar and nicotine in the sidestream smoke which does not exit through the filter. Thus, the problem of "Second-Hand Smoke" is not alleviated.

The latest technology is a "heat" cigarette, known as Eclipse and sold by R. J. Reynolds, which employs a carbon core in the cigarette. This new cigarette attempts to reduce the tar and nicotine levels by reducing the combustion in the cigarette. This new cigarette does not burn at the conventional 800° C., but instead heats the tobacco to less than 300° C. This low temperature reduces combustion, thereby reducing tar formation and also the distillation of nicotine. The "no burn" cigarette purportedly produces lower levels of tar and nicotine in the mainstream and sidestream smoke than previously known cigarettes. Even the new cigarette Eclipse, however, accomplishes the reduction of tar and nicotine by a physical property: temperature. The new Eclipse, or "no burn" cigarette, reduces the tar and nicotine by more than 70%, but, as with conventional filters, it changes the flavor and character of the smoke, thereby reducing the pleasure of smoking. Cigarette burning produces flavor. The "no burn" cigarette likely tastes different and its acceptability in the market-place is uncertain.

Several earlier patents have attempted chemical methods of reducing tar and nicotine in cigarettes. Chemical approaches in facilitating the reduction of harmful organics and /or carbon monoxide in smoking compositions are referenced in numerous patents. These fall into three general categories: salts of carboxylic acids, metals, and oxides of transition metals.

In U.S. Pat. No. 4,489,739, Mattina, Jr. and Selke used citrate salts of potassium, ammonium and magnesium as an additive in smoking preparation. When the input is between 6.5% to 20% based on weight of the filler, the reduction of carbon monoxide is 25 to 50%. Other carboxylates such as acetate and tartrate were also effective in reducing carbon monoxide. In tobacco, citrates are found in combination with nicotine and other alkaloids. The salts of the alkaloids are not as volatile as the free base and therefore their incorporation may reduce some of the harmful organics in the smoke condensate. The nitrates are also a component of the tobacco in-vivo.

U.S. Pat. No. 3,180,458 correlates the reduction of tar to the increase in tobacco burn rate. In U.S. Pat. No. 3,380,458 by Touey et al., other salts of potassium and sodium nitrates were introduced as tobacco additives. They reported that a salt additive of 6–9% caused tar reduction by as much as 34%. The inventors believed that the nitric acid salt possesses a much higher thermal decomposition temperature than the burning tobacco. Their presence at the burning tobacco of the cigarette reduces tar formation. The salts of carboxylates and the like were also incorporated into cigarette wrappers to reduce either tar or carbon monoxide from the side stream smoke in U.S. Pat. No. 5,121,759, U.S. Pat. No. 4,561,454, U.S. Pat. No. 4,231,377 and U.S. Pat. No. 3,782,393. All of these prior art patents evidence the long-felt need for effective reduction and control of tar and nicotine levels in cigarettes.

Chemical additives of metals with valence +2 for the purpose of removing nicotine from tobacco smoke are discussed in U.S. Pat. No. 5,462,072 to Brown and Robertson. They demonstrated that the ferrous ammonium sulphate and not the ferric ammonium sulphate is effective in removing about 17% of the nicotine from the tobacco smoke. British Pat. No. 841,074 disclosed that tobacco treated with the platinum group metals lowers the benzopyrene carcinogen in the smoke. U.S. Pat. No. 4,236,533 to de Clara discloses that the treatment of a tobacco composition with an mixture of catalysts composed of gold, silver, platinum and cerium compounds reduces a small percentage of polycyclic aromatic hydrocarbons and nicotine. U.S. Pat No. 4,317,460 to Dale and Rooney describes the catalysts of tin and other materials for low temperature oxidation of carbon monoxide to carbon dioxide used in smoking product filters.

U.S. Pat. No 4,397,321 to Stuetz discloses a tobacco smoking preparation comprising tobacco, a potassium or calcium compound, and a transition metal compound. The potassium and calcium compounds in the form of oxides, hydroxides, nitrates, carbonates, permanganates, carboxylic acid salts promote oxidation. The preferred transition metal compounds in the Steuetz patent are oxides of iron and manganese. This patent discloses three examples, none of which specifically use a potassium or calcium compound. Instead it uses a nondescript cigarette ash from previous runs, which is backblended into a new tobacco substance.

Metal analysis of the ash showed that calcium comprised 20% and potassium only amounted to 12% by weight. The treatment reduced the level of carbon monoxide in the smoke. The input of transition metal oxides are tremendously large, from 40 mg to 400 mg of manganese. The single example given for reduction of tar was 55% while the reduction of nicotine was 64%.

U.S. Pat. No. 3,943,940 Minami proposed a smoking filter to remove nicotine from the smoke. An aqueous solution of potassium permanganate ($KMNO_4$) and chlorine is impregnated in the filter. The author also discusses that the aqueous $KMNO_4$ solution is unstable and they use chlorine to stabilize it. There was no example presented to document a claim of formation of nicotinic acid (see FIG. 1). The Minami patent erroneously labeled nicotinic acid as an oxide of nicotine. It is not even clear to what extent permanganate really contributes to the oxidation of nicotine if the water barrier filter is also removing nicotine from the smoke.

Metal Oxides of Zinc are especially effective in causing a decrease of polycyclic aromatic hydrocarbon by about 50% (See Norman et al. 1973 U.S. Pat. No. 3,720,214). The same group of authors also discloses in U.S. Pat. No. 3,893,464, U.S. Pat No. 4,216,784, and U.S. Pat. No 4,248,251, that zinc oxide, palladium, nitric oxide in combination with each other are also effective in lowering the polycyclic aromatic hydrocarbon.

All of these prior art chemical methods have failed to be commercially successful primarily because the results attained are less significant than those achieved by the physical means as described above. Many of the prior art conventional methods can accomplish a reduction of tar and nicotine only by 40% or less. Some methods border on alchemy such as employing cigarette ash. Some use precious metals of gold, platinum or silver or add inordinate amounts of chemicals such as 400 mg of manganese dioxide. Some additives are impractical, such as a liquid filter containing potassium permanganate and chlorine. Finally, most prior art chemical methods appear to have an all or none effect, i.e., there is no dose-response relationship. The only exception to the cited references is the patent to Touey. The response in Touey, however, is low and levels off at less than 35% tar reduction.

Oxidation appears to be the common element in the chemical approaches to reducing tar, nicotine, polycyclic aromatic hydrocarbon and carbon monixide. Most of the known oxidants are the metal oxides, which achieve less tar and nicotine reduction than the physical methods.

Permanganate is an active oxidant which is at a higher oxidation state than its oxide, manganese dioxide. Therefore, it is unstable especially in the presence of moisture and other oxidizable organic material. Scheme 1, shown below, depicts the reaction whereby permanganate consumes 2 molecules of water and converts to the more stable and less reactive oxidant manganese dioxide. There is also a dramatic color change because permanganate ion is red to purple in color and the manganese dioxide is brown. This is readily observed when permanganate powder is placed on a piece of white paper. In a matter of a few days the paper turns brown. When powdered permanganate is blended with tobacco, which like paper is also cellulosic, and upon storage, the permanganate is progressively deactivated and is converted to manganase dioxide. Hence, any prior claim of permanganate as the active oxidant in tobacco resulted in disadvantages. The additive of permanganate, unless it is protected from direct contact with tobacco and moisture, is converted to manganese dioxide.

In the present invention, permanganate is emulsified in Sterotex and is devoid of contact with tobacco and moisture. It is therefore safely protected from premature oxidation by the inert Sterotex.

In the high temperature coal of the burning cigarette, carbonized tobacco oxidizes organics to carbon dioxide and water. Consequently, this zone becomes highly deficient in oxygen, thereby inhibiting complete combustion. The organics present in this zone are volatile intermediates of pyrolysis. Nicotine remains unchanged in this zone and is inhaled along with other organic condensates such as polycyclic aromatic hydrocarbons in the mainstream smoke. At or near the char line of a burning cigarette, the thin tobacco paper permits the infusion of large amounts of oxygen and thus enhances the combustion of nicotine to be found in the sidestream gaseous phase.

Oxidation is both natural and common in the burning cigarette. The present invention uses an oxidant emulsified in an inert combustible vegetable oil Sterotex. The oxidant, Permanganate, donates two molecules of oxygen to overcome the oxygen deficiency at the burning coal, and the Sterotex enhances the burning of the tobacco to promote the complete oxidation of organics. Clearly tar and nicotine and other harmful organics are lowered in the mainstream smoke condensate.

SUMMARY OF THE INVENTION

The present invention has been made in view of the above circumstances and has as an object to produce a smoking article such as a cigarette with low risk of "second hand" smoke, low tar and nicotine to the smoker, produces vitamin B6 in the smoke and has a pleasant flavor and scent. A further object of the invention is to produce cigarettes which can be adjusted linearly to deliver a wide range of Federal Trade Commission (FTC) "tar" and nicotine levels; the lowest amount being 1.0 mg of FTC "tar" and 0.2 mg of nicotine.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a cigarette of this invention comprises a combustible filler, an oxidant, vegetable oil and cigarette paper.

BRIEF DESCRIPTION OF THE DRAWINGS

The accompanying drawings, which are incorporated in and constitute part of this specification illustrate embodiments of the invention and, together with the description, serve to explain the objects, advantages, and principles of the invention. In the drawings.

DETAILED DESCRIPTION OF THE PERFERRED EMBODIMENTS

Figure 1:
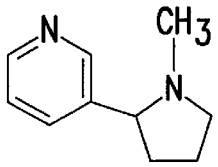
FIG. 1 is a diagram of the oxidation of nicotine to Nicotinic Acid.
Figure 1:
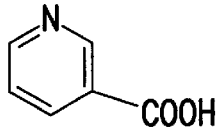
Figure 1:
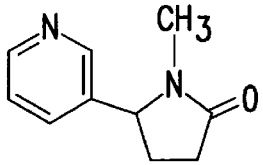
Figure 1:
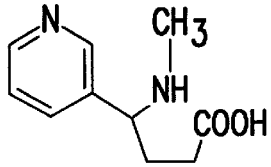

The present invention embodies the control of tar and nicotine via a "chemical approach" and through the incorporation of one or more chemicals to regulate the natural oxidation process in the burning cigarette. Implicit in this invention is the elimination or reduction of nicotine and other harmful tobacco alkaloids by oxidation to their inert n-oxides or complete combustion to carbon oxides and water. Alternatively, the nicotine is oxidatively degraded at the pyrrolidine ring to a beneficial intermediate of nicotinic acid. The best mode of practicing the invention is with permanganate ($KMNO_4$) and Sterotex which synergistically control the level of tar and nicotine in cigarettes. The Sterotex serves as a "synergistic partner" to the permanganate.

The invention demonstrates a new use of a mild oxidant, permanganate, in tobacco. Permanganate donates two molecules of oxygen to overcome the oxygen deficiency at the burning coal and generates yet another oxidant, manganese dioxide (See Scheme 1 below). This promotes a cascade of oxidation to completely oxidize the harmful organics in cigarette (See Schemes 2 and 3 below). Sterotex presumably lowers the energy of activation of permanganate and the combined elements synergistically contribute to even better oxidation of tobacco and organic constituents at the burning coal. Clearly tar and nicotine are lowered in the mainstream and sidestream smoke condensate. The mode of oxidation is similar to the natural process and therefore it is both safe and predictable. Potassium permanganate has been used to obtain drinkable stream water in the wilderness and in small doses is not toxic. At the burning coal, permanganate produces a metallic manganese that will remain in the ashes.

The present invention is contrary to the teaching of the prior art because chemical processes were thought to generate new species of unknown chemical entities, which may be more harmful. The unexpected results achieved with this invention are far superior than the results of the prior-art references. The invention is very useful because the range of control for tar and nicotine is unlimited. There is less problem with second-hand smoke because the enhanced oxidation lowers harmful organics in both the main and side-stream smoke.

A smoking article in accordance with this invention has incorporated therein at least 10 mg of $KMnO_4$ and 35 mg of Sterotex. The smoking article may be any brand of commercially available cigarettes either filtered or unfiltered. The synergistic elements of potassium permanganate and Sterotex may be admixed in a mortar and pestle. More preferably the elements may be prepared together as disclosed in Example 3. This process results in a fine powder in which the permanganate is trapped in Sterotex. The fine powder may be dusted and slowly incorporated onto the tobacco filler or even sprayed in an inert volatile solvent. The treated tobacco filler is then assembled into a tobacco rod. Alternatively, a powdered melange, as in example 1, containing $KMnO_4$, Sterotex, vanilla flavor and herbal additive may be used. The vanilla flavor and herbal additive provide a pleasant scent for smoking pleasure and environmental friendliness.

Schemes $$MnO_4^- + 2H_2O + 3e \Rightarrow MnO_2 + 4\ OH^- \quad \text{scheme 1}$$

$$MnO_2 + 4H^+ + 2e \Rightarrow Mn^{2+} + 2\ H_2O \quad \text{scheme 2}$$

$$Mn^{2+} + 2e \Rightarrow Mn \quad \text{scheme 3}$$

$$Cr_2O_7^- + 14\ H^+ + 6e \Rightarrow 2\ Cr^{3+} + 7\ H_2O \quad \text{scheme 4}$$

The following examples are illustrative of the present invention. The specific ingredients and processing parameters are presented as being typical, and various modifications can be derived in view of the disclosures as presented within the scope of the invention. Examples 1 and 2 feature the reduction of tar and nicotine by potassium permanganate and Sterotex (granular vegetable oil) as an additive to the tobacco. The blending of $KMnO_4$ Sterotex is only for temporary measure and has limited stability primarily due to the unstable nature of the $KMnO_4$ in contact with moisture and oxidizable organic matrix. Example 3, describes a method to stabilize potassium permanganate by emulsifying it in Sterotex.

Although the above description has been made with respect to potassium permanganate as the oxidant and Sterotex as the matrix material, other materials can suitably be used. For example, the active oxidant can also be a peracid, perchlorate, periodate, or peroxide. Suitable matrix materials include a C14–C22 fatty acid; a glycerin ester; one or more of naturally occurring oils, fats and waxes from plant and animal sources; a synthetic triglyceride of long chain fatty acids of myristic C14, palmitic C16, stearic C18, arachidic C20, and lignoceric C24, which emulsifies the active oxidant; or an unsaturated fatty acid ester, which is totally inert due to hydrophobicity.

EXAMPLE 1

One or more objects of the present invention are accomplished by uniformly dispersing Sterotex admixed with potassium permanganate in a combustible filler and assembling the resulting composition in a commercial cigarette paper holder and filter, such as in a Marlboro or any other commercial brand cigarette. To enable the binding of the powder to the tobacco, all of the ingredients are finely powdered and include the carrier comfrey which possesses an adhesive property. Some flavor and scent ingredients and dextrose, a combustible carrier, are also added. Preferably, the final ingredients are: 1 gram melange powder consisting of: 120 mg of $KMnO_4$, Sterotex 350 mg, comfrey 105 mg, dextrose 100 mg, vanilla bean 105 mg, synthetic vanilla 20 mg, licorice 40 mg, turmeric 10 mg and powder of menthol leaves 150 mg. The incorporation procedure involves: (1) spraying highly humidified tobacco from a single cigarette with isoctane (2) carefully dusting and folding slowly and evenly the permanganate/Sterotex melange onto the tobacco and (3) reconstituting the treated tobacco into the cigarette paper holder on top of the filter element and conditioning the cigarette at 25° C. and 60% humidity for one to two days. In the control experiment, the tobacco is also humidified and then reconstituted with or without the addition of carrier comfrey into the cigarette. The untreated control is a commercial Marlboro light cigarette.

The control and treated cigarettes were smoked under standard FTC conditions. The puffing regimen consisted of 35±0.5 ml puff volume, a puff duration of 2 seconds and a puff frequency of 1 puff per 60 seconds. In early studies 5 cigarettes were smoked per Cambridge filter. However, a method was developed with good precision and sensitivity to measure single cigarette filter. FTC "nicotine" was determined by capillary gas chromatography employing a HP5890 gas chromatograph equipped with a 30 meter megabore carbowax column and flame ionization detector (FID). FTC "tar" is by constant weight of filter determination.

The process of reconstitution did not affect the tar content (Table 1). However, in other experiments a 10% to 15% change in tar content was observed. This small change is contrasted with the dramatic reduction of FTC "tar" typically by about 80% when only 2% permanganate and 5.8% of Sterotex (both are as percent by weight of tobacco) is incorporated into the cigarette. The chemical process transformed a full flavor low tar cigarette of 11 mg of tar to an ultra-ultralight cigarette of 2 mg of tar.

The chemical process controls the level of tar simply by adjusting the level of $KMnO_4$/Sterotex melange application to the tobacco. This is illustrated in Table 1, an experiment whereby lesser amounts of potassium permanganate: 1%, 1.65%, and 1.96% and the respective Sterotex: 2.7%, 4.3%, and 5.4% of the tobacco weight are incorporated into separate cigarettes. Makeup weight of carrier comfrey to 150 mg of melange final weight are admixed. As expected, the resultant cigarettes showed corresponding reductions of FTC "tar" of: 47.26%, 63.16% and 86.07%. These experiments and the data points show an approximate linear dose response relationship between the reduction of tar and the amount of applied $KMnO_4$ melange. This linear dose response relationship is highly reproducible, however, other factors may affect the outcome.

The next two data points are included to emphasize one of the factors; the unstable nature of potassium permanganate. The moisture content of the cigarettes in this experiment was purposely raised to full saturation before the treatment with isoctane and then dusted with the permanganate/Sterotex melange. As can be seen in Table 1 at 17/43.7 and 20.1/51.8 inputs of $KMnO_4$/Sterotex, the FTC 'tar' did not decrease but progressively increased. This is due to the premature deactivation of the $KMnO_4$ in contact with moisture. At low input of the permanganate/Sterotex, the make-up weight of comfrey shields the premature moisture attack before the cigarette is smoked. However, at high input of permanganate there is no make up weight of comfrey and the opportunity for the permanganate to encounter moisture is greatly increased. The active oxidant is transformed to manganese dioxide and the effectiveness of oxidation is decreased.

TABLE 1

| Reassembled Cigarette | | Milligram FTC 'Tar' Per cigarette | % Reduction |
|---|---|---|---|
| Control | | 11.82 | 0 |
| Control Un-treated | | 11.58 | 0 |
| Control 150 mg comfrey | | 9.8 | 16.24 |
| $KMnO_4$ | Sterotex | | |
| 7.9 | 20.4 | 6.17 | 47.26 |
| 12.4 | 32.0 | 4.31 | 63.16 |
| 14.7 | 37.8 | 1.63 | 86.07 |
| 17.0 | 43.7 | 2.14 | 81.71 |
| 20.1 | 51.8 | 3.98 | 65.98 |

EXAMPLE 2

Figure 2:
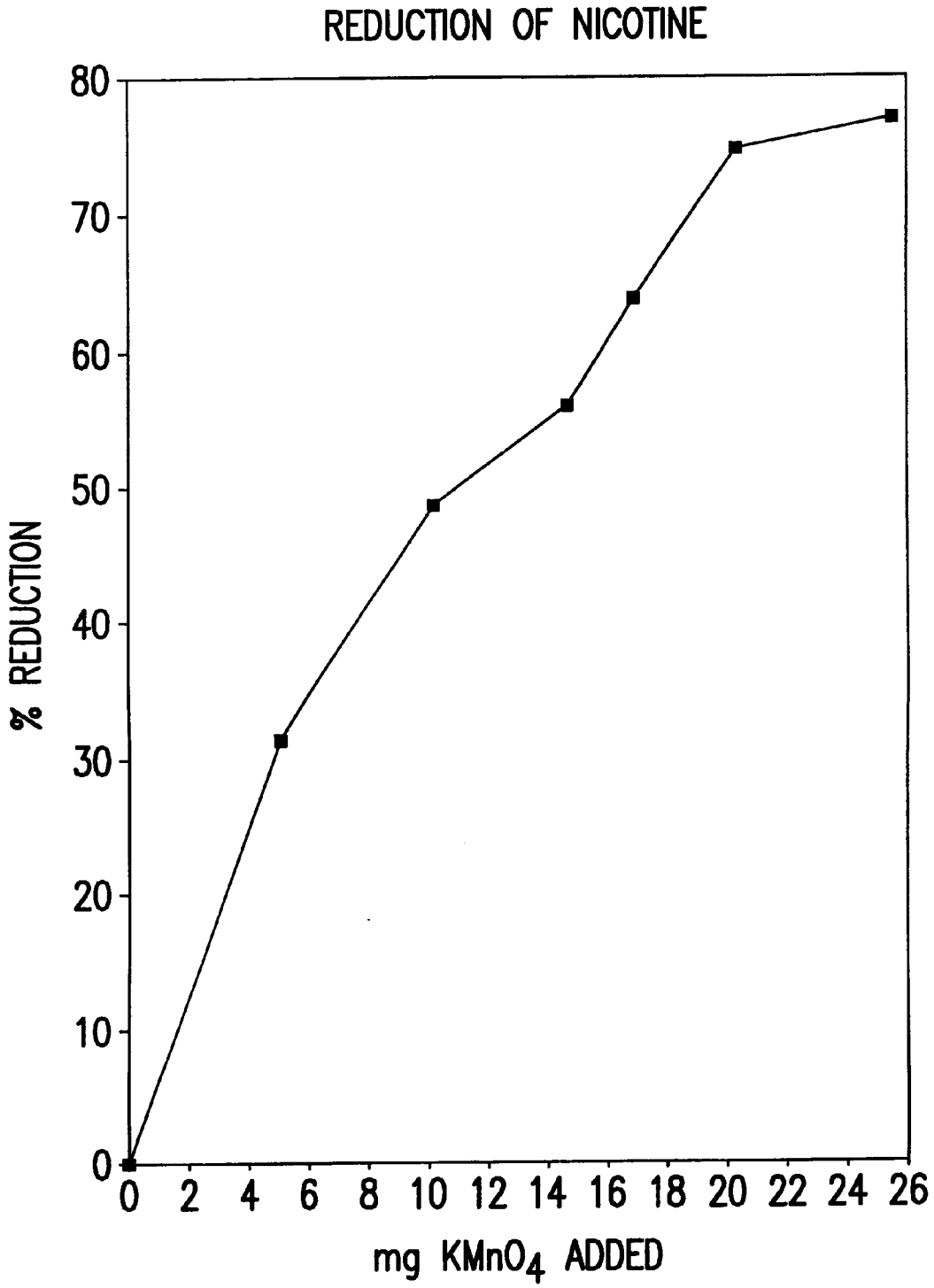
FIG. 2 is a graph displaying a dose response curve of the reduction of nicotine by a Permanganate melange.

The chemical process reproduces easily when the permanganate melange powder is applied evenly on the tobacco. FIG. 2 shows that the level of nicotine can be regulated in much the same manner as that shown in Table 1 for tar. In fact, tar and nicotine in a single experiment (FIG. 3) are directly proportional to each other. The experiment here is chosen to illustrate that when the moisture is not a problem, at high input of the powder equivalent to 22 mg of $KMnO_4$ and more, the response of tar and nicotine may level-off. The observed non-linear response suggests that as more powder is applied, some overlapping of powder surface coverage may occur or that some of the powder may not be available to the tobacco. It further suggests that the effects of the powder melange are localized and do not propagate over long range. The application technique needs improvement in order to cover every inch of tobacco leaf and then the linearity will continue even at the highest input. By contrast, at low inputs of 5 mg to 7.5 mg of the permanganate, the percent tar and nicotine are always linear and predictable. This is attributed to the more randomly available single target sites on the tobacco. More than likely there are no hot spots, whether at the core of the cigarette or the fringe tobacco proximal to the thin cigarette paper. Further refinement will stabilize and protect the permanganate from premature deactivation.

EXAMPLE 3

The role of the component melange in reducing tar and nicotine was studied by examining individually how each group of components reacted when applied to the tobacco.

One unexpected result is that $KMnO_4$ alone cannot account for the total reduction of tar and nicotine. Sterotex, the vegetable oil, plays a synergistic role with $KMnO_4$ in the oxidative control of tar and nicotine. In fact, the inert vegetable oil can be used to coat the permanganate and prevent the premature oxidative attack of the tobacco before the cigarette is smoked. The composite of Sterotex and finely powdered permanganate in approximately 2.9:1 was emulsified in isoctane and then the volatile isoctane allowed to evaporate. The permanganate must be very finely powdered in a mortar and pestle and passed over a fine sieve. The powder will stay suspended when the isoctane is evaporating. Alternatively, the composite may be formed in a sprayer and the fine powder collected.

Figure 3:
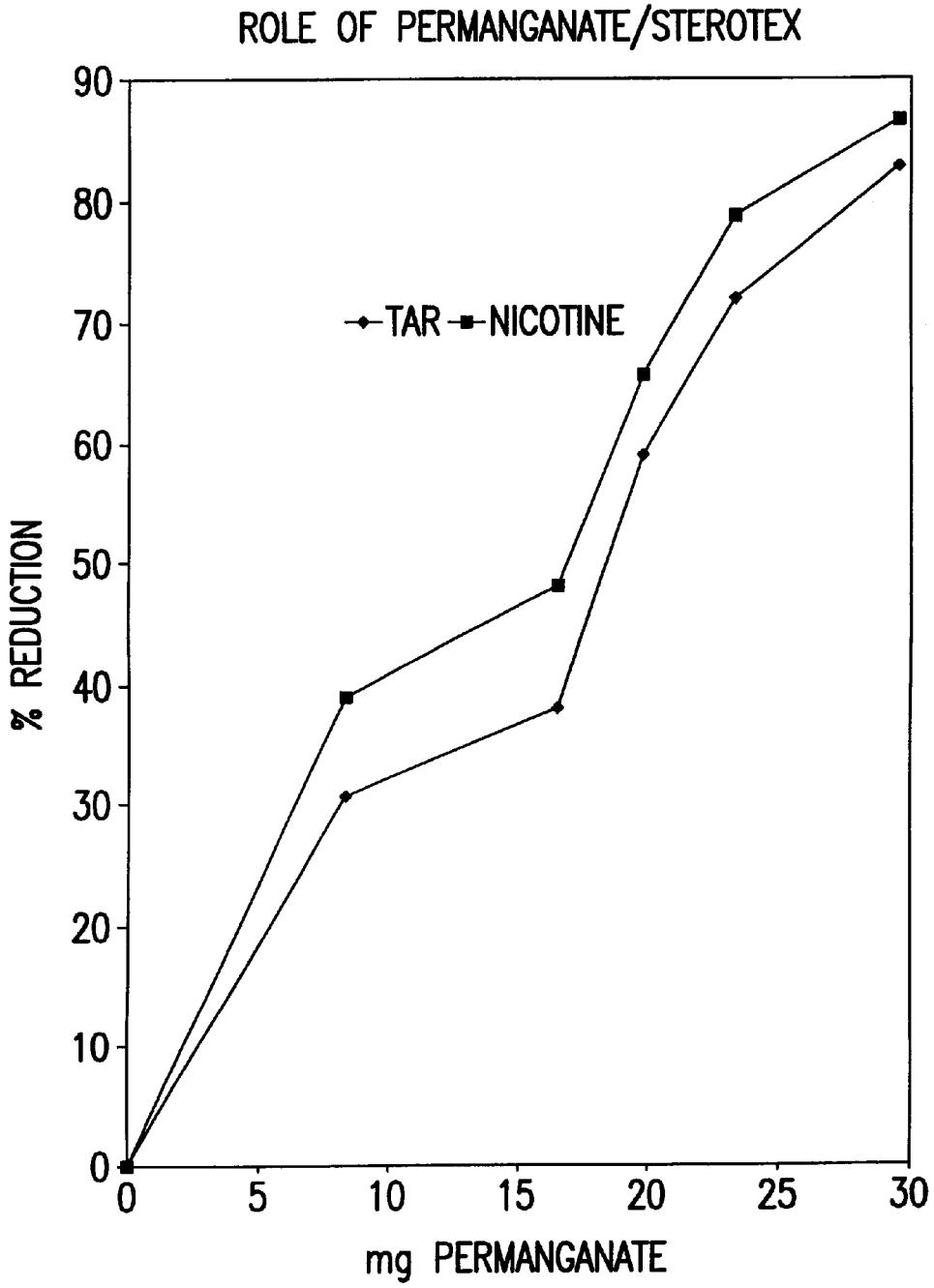
FIG. 3 is a graph of the synergistic reduction of tar and nicotine by Permanganate and Sterotex.

This composite is used to treat tobacco in a series of experiments to assess their synergistic oxidative control. The emulsified $KMnO_4$/Sterotex powder is admixed with make-up weight of powdered comfrey as necessary to 78 mg. The total input powder is about half of that in examples 1 and 2. Also the powder is carefully dusted onto a freshly opened cigarette tobacco without prior moisture or isoctane treatment. In FIG. 3, the % reduction of tar and nicotine are plotted against both ingredients, which are indicated in the x-axis only as the permanganate concentration. At high concentrations of Sterotex and permanganate, the reduction again approaches the 80 percent level whereas, at the low end there appears to be a plateau at about 40–50 percent level. Nevertheless, at all concentrations of the ingredients, tar and nicotine show coordinated and proportional regulation. Clearly, the data demonstrate that the control of tar and nicotine by the melange is due to the combined efforts of permanganate and Sterotex.

Table 2 examines selected Sterotex and permanganate experiments to gain a better understanding of the synergistic control achieved by the synergistic partnership between the Sterotex and the permanganate in this example. The experiments are grouped from low to high and obviously, the higher the input of permanganate and Sterotex, the better the reduction of tar and nicotine. This is especially true in the 70% to 80% groups. When both ingredients are low, the reductions are also much less as in the 30% to 40% group. In the intermediate 50% group, the Sterotex concentrations are all relatively high, at 33 to 50 mg whereas the permanganate concentration may be as low as 15 mg(data not shown). Sterotex is obviously important. For example without any Sterotex and at permanganate concentrations of 17.5 mg and 21.6 mg, the reduction level is low.

TABLE 2

The Synergistic Control of Tar and Nicotine by Permanganate and Sterotex

| Group | $KMnO_4$ | Sterotex | % Reduction |
|---|---|---|---|
| 30 to 40 percent | 8.55 mg | 13.95 mg | 30.5% |
| | 17.5 mg | 0 mg | 42% |
| | 21.6 mg | 0 mg | 36% |
| | 17.07 mg | 13.95 mg | 36.5% |
| 50 percent | 17 mg | 50 mg | 56.9% |
| | 20.5 mg | 33 mg | 59.1% |
| 70 to 80 percent | 23.77 mg | 38.8 mg | 71.8% |
| | 29.64 mg | 48.4 mg | 82.3% |

This data is especially revealing by comparing the 17 mg permanganate experiments across the groups: 36.5% reduction in the 17.07/13.95 example and 56.9% reduction in the 17/50 example. The observed jump of 20% reduction in the 17/50 mg experiment clearly establishes the enhancement by Sterotex. In fact, the enhancement is certainly in evidence for the entire medium to high groups of 50%, 70% and 80%. An incremental change in permanganate coupled with the high Sterotex concentration has resulted in greater enhancement of percent reduction of tar and nicotine. There is however a critical concentration of Sterotex that has to be reached for the synergism to take effect. Table 1 suggests that it is at about 35 mg of Sterotex. This is also the basis for the plateau seen in FIG. 4, and the sharp rise of percent reduction is due to the observed synergism.

No experiments are available at present to elucidate the mechanism of the synergism between permanganate and Sterotex. However, Sterotex is an excellent combustible material and in combustion all organics are oxidized to carbon oxides and water. Perhaps it is the water that is generated during combustion which is required for the permanganate oxidation as shown in Scheme 1. Also plausible is the protective effects of Sterotex on permanganate as discussed above. Alternatively, Sterotex lowers the energy of activation of permanganate in the reaction of scheme 1 and drives the equilibrium to the right. In this context, the effect observed by the sundry other combustible material in the permanganate melange also conform to the effects of Sterotex. Regardless of the mechanism of the synergism, the examples demonstrate the existence of the synergism and the advantages of the invention.

EXAMPLE 4

Figure 4A:
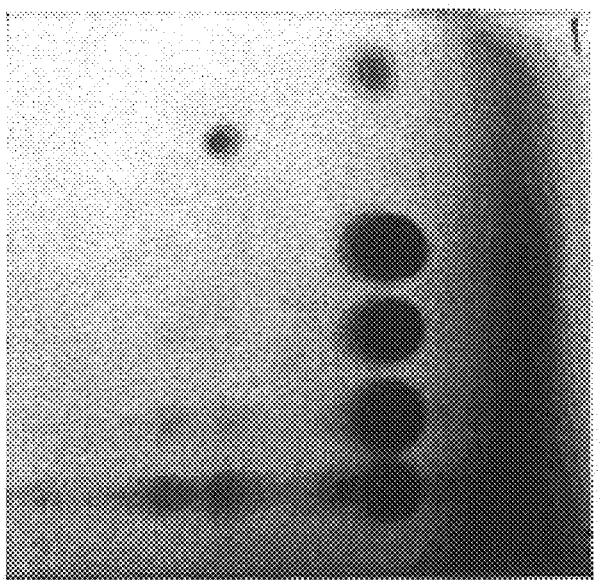
FIGS. 4*a* and 4*b* are thin layer chromatographes of nicotine at different weight ratios of the oxidants permanganate and dichromate, respectively.
Figure 5A:
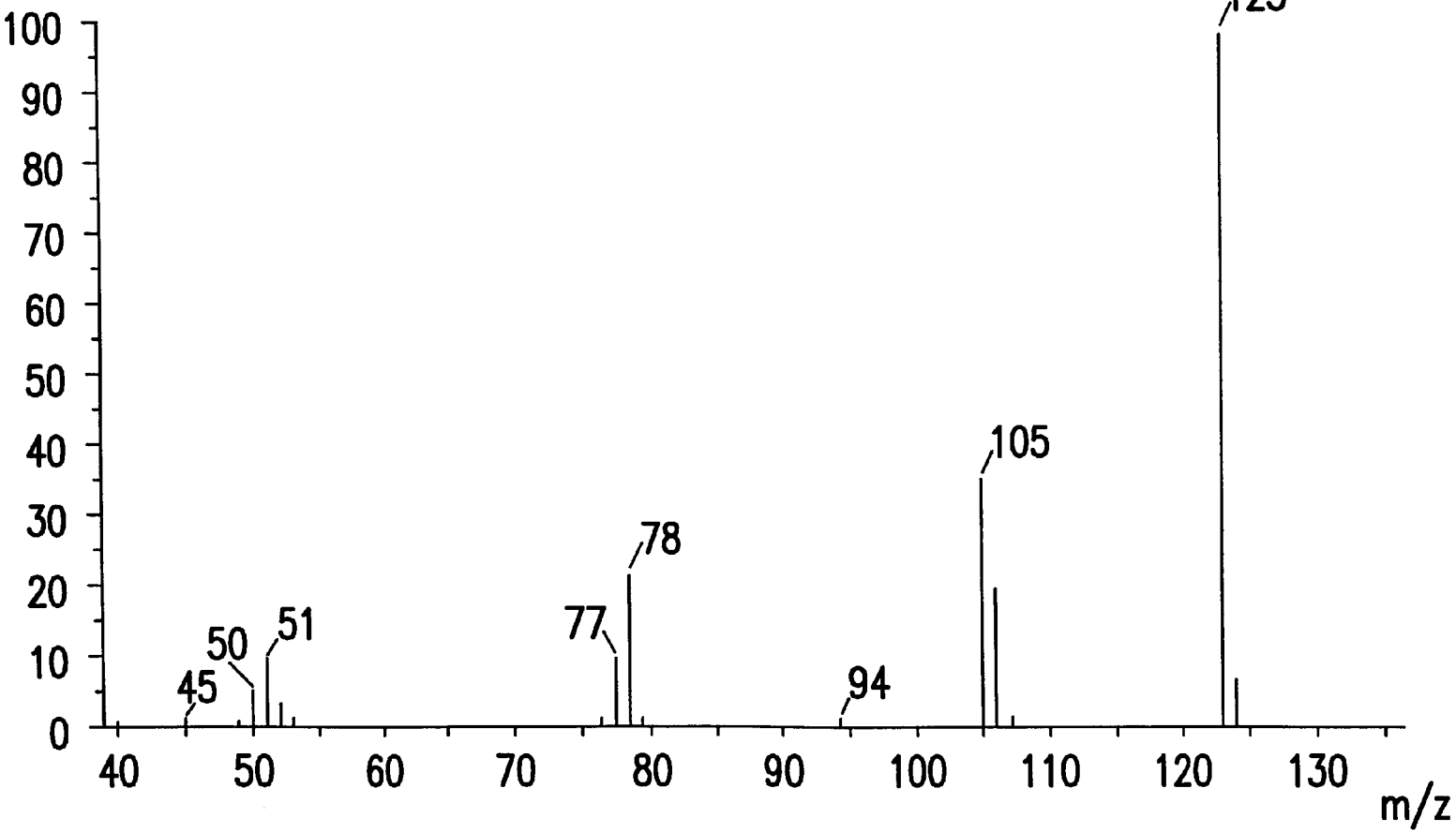
FIG. 5 is a mass spectrometry analysis of Nicotinic Acid.
Figure 5B:
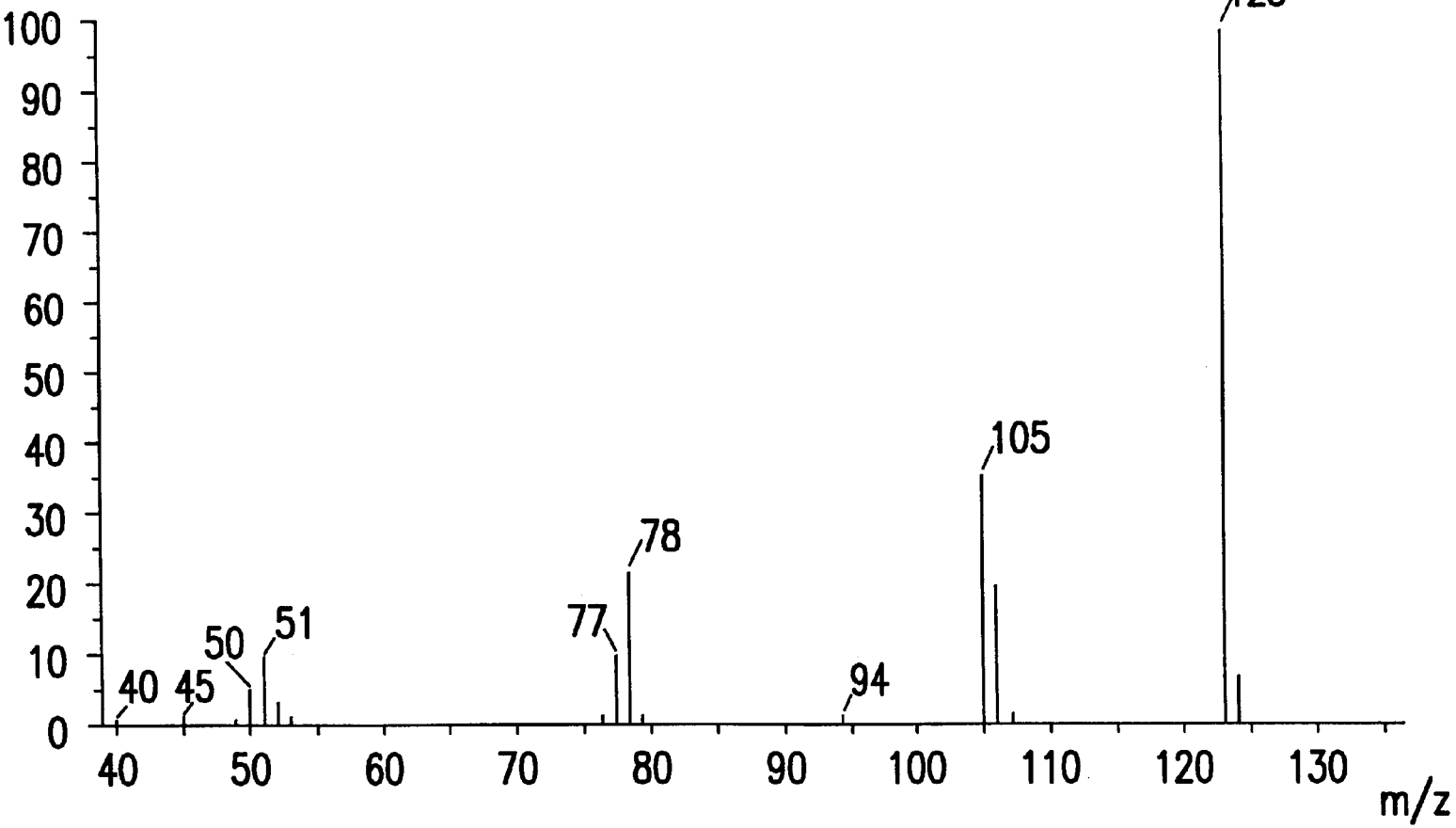
Figure 6:
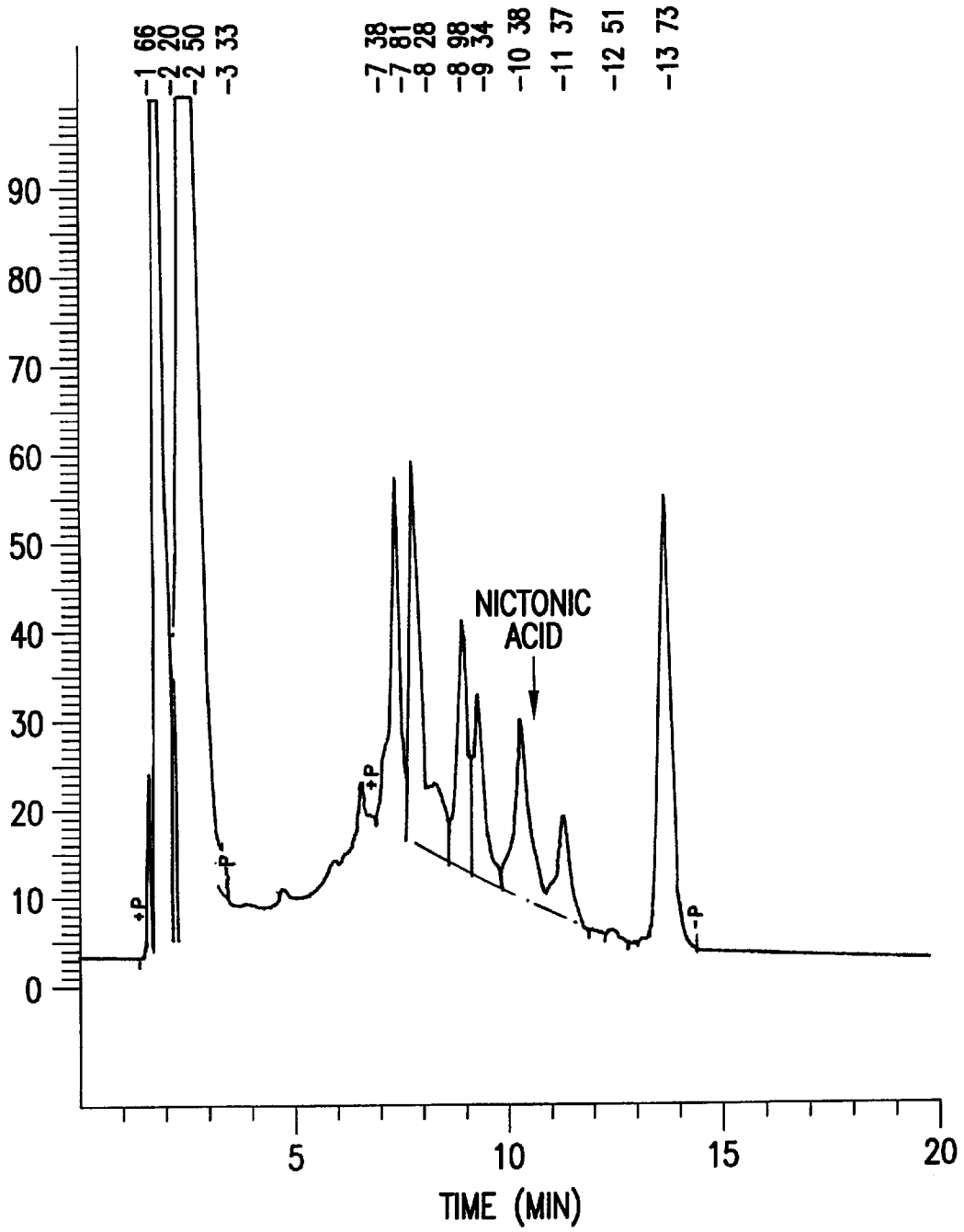
FIG. 6 is an LC Chromatography of Nicotinic Acid in cigarette smoke condensate.

In order to examine the oxidation of nicotine by $KMnO_4$, a simplified system consisting of pure nicotine was studied. FIG. 4*a* shows the Thin Layer Chromatography of nicotine at different molar ratios of $KMnO_4$. At 1:1 weight ratio and heated to 130° C. for 15 minutes, nicotine is converted to a compound with the same mobility as nicotinic acid. The reaction mixture was chromatographed on a DEAE (diethylaminoethyl) sephadex column and the nicotine washed with a volatile buffer. The negatively charged species in the reaction were eluted stepwise with increasing volatile salt of trimethylamine acetate. At 0.1–0.15 M of salt nicotinic acid was recovered from the column as monitored by HPLC (High Pressure Liquid Chromatography) and GC (Gas Chromatography). In HPLC the nicotinic acid UV spectrum was scanned with a photodiode array detector. However, the ultimate confirmation of nicotinic acid was by mass spectrometry. FIG. 5 illustrates the identical EI (positive mode ) mass spectra showing the parent ion m/z of 123 for both the isolated nicotinic acid and the standard. Additionally, the daughter ions m/z 78 demonstrate the structure of the pyridine moiety of nicotinic acid.

Figure 4B:
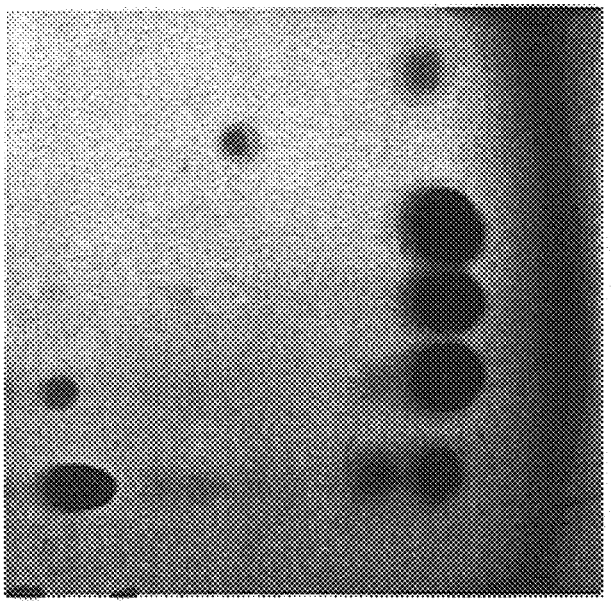

Not all oxidants produce nicotinic acid. It is known that peroxides oxidize nicotine to the n-oxides, oxygenation occurring at the aliphatic nitrogen atom. FIG. 4*b* shows the oxidation of $K_2Cr_2O$, at a weight ratio of 1:1. The major product as seen by thin layer chromatography is a different compound than nicotinic acid. The mechanism of oxidation (scheme 4) is more preferably in strong acid. The mechanism of oxidation by $KMnO_4$ is via the scheme as shown in FIG. 1. This pathway was elucidated by isolating the intermediate of oxidation n-methyl-4-(2'-pyridinyl) butyric acid. The structure is deduced from mass spectrometric analysis m/z of 194. Further verification are from the fragmentation ions of the parent ion: m/z 178, 151, 134, 106 and 78. This intermediate is the result of ring opening of the oxidized nicotine and specifically, cotinine or n-methyl-4-(2'-pyridinyl) butyrolactam. The conversion of cyclic tertiary amine, such as nicotine into corresponding lactams(2-pyrrolidinone) has previously been carried out using metal oxides as well as autooxidation and halogens.

EXAMPLE 5

The smoke condensate collected on Cambridge filters of 5 cigarettes treated with the permanganate melange was extracted with 2-propanol. The aqueous extracts of ionic species in the smoke were facilitated with the addition of water and several drops of 0.5 M trimethylamine acetate. Alcohol was removed from the aqueous layer along with the organic layer with the repetitive extraction of hexane and chloroform. The resultant aqueous layer was lyophilized and redissolved in 2 ml of 0.05M Trimethylamine acetate pH 4.5. Nicotinic acid was positively identified by HPLC employing an amino column and eluting with a mobile phase of 20% acetonitrile and 0.05 M trimethylamine acetate pH4.5. The purity of the peak was checked by photodiode array scanning. The peak represents approximately 7.5 ug/ml of nicotinic acid.

EXAMPLE 6

A Camel unfiltered cigarette was tested with 120 mg of melange, which corresponds to 14.4 mg of $KMnO_4$ and 42 mg of Sterotex, and the mainstream smoke was analyzed by the FTC method. The Camel control cigarette showed 29.21 mg of Tar and 2.46 mg of nicotine. The treated Camel cigarette displayed 11.0 mg of tar and 0.68 mg of nicotine. The percent reduction of tar was 62% and the nicotine 72%. The simple treatment converted the unfiltered full flavored cigarette into a light cigarette. This experiment indirectly addresses the reduction of tar and nicotine in the side-stream smoke of a filtered cigarette because the side-stream smoke is also unfiltered.

In this age of moral passion for good health, smoking is unpopular. This invention presents an acceptable justification which is politically correct for those who enjoy smoking and those who must smoke. The invention embodies the control of tar and nicotine via the enhancement of natural oxidation and combustion processes in the burning cigarette. Tar and nicotine in the mainstream smoke are further oxidized to carbon oxides and water. Alternatively, the nicotine is oxidatively degraded at the pyrrolidine ring to a beneficial intermediate of nicotinic acid. It is also known as niacin which was coined to avoid any connotation in association with nicotine in the lay mind. Niacin is a B6 vitamin. It functions as a coenzyme in many oxidation reduction reactions in the body. It is therefore an essential vitamin. The transformation of a drug to a vitamin may quiet even the harshest anti-smoking critic. The apparent new image of acceptable smoking is certainly a breath of fresh air admist the smoke and fire for the number one cash agricultural crop, tobacco.

Other additional advantages include:

The invention permits the manufacture of a wide range of cigarettes with predictable amounts of tar and nicotine. By simply adjusting the input of permanganate melange, different cigarettes can uniquely be tailored to accommodate the smoking pleasure of individual smokers.

The invention permits the smoker to indulge in a pleasant wonderful peppermint vanilla scent without fear of the overdose of tar and nicotine. Many restaurants and bar establishments may allow smoking of no tar and nicotine cigarettes in order to help their core business.

The invention permits the smoker who loves the sensation of a burning cigarette an alternate choice to avoid the frustration of smoking an ultra-light cigarette or the new no burn cigarette.

Although the description above contains many specifications pertaining to cigarette article, these should not be construed as to limiting the scope, but as merely providing illustrations of the presently preferred embodiments of this invention. For example, other popular smoking articles cigars, pipes, which use tobacco in various forms can also be controlled by the same process.

The Nicotine patch is a pharmaceutical prescription used as an aid in withdrawal from nicotine addition. It is an excellent product that has helped millions of smokers. However, many individuals resume smoking because there is a need for either the act of lighting a cigarette or the need for oral fixation. The current invention provides an alternative to those who are compelled to smoke. The treated cigarette can provide the necessary tactile sensation of smoking aroma and lighting-up without the ill effects of tar and nicotine. It certainly can be used as a cease-cigarette much in the same manner as Nicotrol.

The foregoing description of the preferred embodiments of the invention has been provided for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What I claim is:

1. A process for forming a complex, comprising embedding an active oxidant in an effective amount of an inert matrix to form a complex, wherein said inert matrix functions to prevent premature oxidation of the oxidant, and said inert matrix is hydrogenated cottonseed oil, and wherein said active oxidant is selected from the group consisting of a peracid, a perchlorate, a periodate, a peroxide, and a permanganate.

2. A process according to claim 1, wherein said inert matrix is refined, bleached, hydrogenated, filtered and deodorized cottonseed oil.

3. A process according to claim 1, wherein said active oxidant is otherwise unstable when not embedded in said inert matrix.

4. A process according to claim 1, wherein said active oxidant is a peracid.

5. A process according to claim 1, wherein said active oxidant is a chemical selected from the group consisting of perchlorate, periodate, and peroxide.

6. A process according to claim 1, wherein said oxidant oxidatively degrades nicotine at the pyrrolidine ring to a beneficial intermediate of nicotinic acid.

7. A process according to claim 1, wherein said active oxidant is potassium permanganate.

8. A process according to claim 1, wherein said inert matrix comprises Sterotex.

9. A process according to claim 1, wherein said complex functions synergistically to reduce tar and nicotine in a smoking article.

10. A process according to claim 1, wherein said oxidant oxidatively converts nicotine to vitamin B6.

11. A process according to claim 10, wherein said oxidative conversion includes a lactam intermediate on the pyrrolidine ring.

* * * * *